US008201913B2

(12) United States Patent
Govyadinov et al.

(10) Patent No.: US 8,201,913 B2
(45) Date of Patent: Jun. 19, 2012

(54) DROP DETECTOR

(75) Inventors: Alexander Govyadinov, Corvallis, OR (US); Tommy D. Deskins, Albany, OR (US); Kenneth Ward, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 408 days.

(21) Appl. No.: 12/426,546

(22) Filed: Apr. 20, 2009

(65) Prior Publication Data

US 2010/0265287 A1 Oct. 21, 2010

(51) Int. Cl.
*B41J 29/393* (2006.01)
*B41J 29/38* (2006.01)

(52) U.S. Cl. ..... 347/19; 347/9; 347/14

(58) Field of Classification Search ..... 347/9, 14, 347/19

See application file for complete search history.

(56) References Cited

U.S. PATENT DOCUMENTS

| | | | | |
|---|---|---|---|---|
| 6,726,318 | B2 * | 4/2004 | Arakawa | 347/19 |
| 7,233,015 | B2 | 6/2007 | Roberts | |
| 2008/0211849 | A1 * | 9/2008 | Pierik et al. | 347/14 |
| 2009/0033692 | A1 | 2/2009 | Giri et al. | |
| 2010/0149594 | A1 * | 6/2010 | Pawlik et al. | 358/1.16 |

* cited by examiner

*Primary Examiner* — Matthew Luu
*Assistant Examiner* — Jannelle M Lebron

(57) ABSTRACT

In one embodiment, a drop ejector assembly includes a printhead, a drop zone immediately downstream from the printhead, an array of optical fibers exposed to the drop zone such that light scattered off drops in the drop zone illuminates at least some of the optical fibers in the array, and a photo detector operatively connected to the array of optical fibers for converting light from the optical fibers into an electrical signal. In another embodiment, a drop detector includes a light source for illuminating drops passing through a drop zone and a light sensor for sensing light scattered off drops in the drop zone. The length of drop zone is 3 mm or less and the light sensor has a cross sectional dimension less than the length of the drop zone.

6 Claims, 12 Drawing Sheets

DROP DETECTOR

BACKGROUND

Inkjet technology is being adapted for use in automated liquid handling (ALH) systems for precisely dispensing minute volumes of liquids used in pharmaceutical and other laboratory or analytical applications. In one example ALH application under development, an inkjet drop ejector (commonly referred to as a "printhead") is used to dispense a predetermined volume of liquid into small sampling reservoirs, called "wells", in a well plate. A well plate may house an array of thousands of individual wells. It is desirable in such applications to precisely control the volume of liquid dispensed into each well. It is helpful in controlling the volume of liquid dispensed into each well to monitor some of the characteristics of the ejected drops such as, for example, drop count, drop velocity and drop volume.

DRAWINGS

The same part numbers designate the same or similar parts throughout the figures.

DESCRIPTION

Drop detectors are being developed for use with inkjet drop ejectors to monitor some of the characteristics of the ejected drops such as, for example, drop count, drop velocity and drop volume. Developing drop detectors for inkjet ALH applications is particularly challenging due to the short distances, no more than 3 mm for example, between the ejector nozzles (from which drops are ejected) and the well plate (into which the drops are ejected). In addition, the well plate and ejector nozzles must be allowed to move relative to one another for proper positioning to dispense liquid into the desired wells on the appropriate well plate, making it difficult to locate drop detection components near the ejector nozzles. The inventors have discovered that fiber optics may be used to enable the detection of light scattered off drops of liquid passing through such a very short drop zone. Accordingly, embodiments of the present disclosure were developed in an effort to integrate fiber optics and other miniature light collecting and sensing technologies into a drop detector for inkjet ALH systems with short distances between the ejector nozzles and the well plate and to allow for a greater degree of freedom of movement for positioning the well plate and ejector nozzles. Embodiments of the disclosure, however, are not limited to inkjet ALH but may be used in applications using other drop ejection techniques. Hence, the following description should not be construed to limit the scope of the disclosure, which is defined in the claims that follow the description.

As used in this document: a "fiber optic light sensor" means a light sensor that uses one or more optical fibers to collect, transport and/or otherwise sense light; "liquid" means a fluid not composed primarily of a gas or gases; and a "printhead" refers to that part of a drop ejector that expels drops of liquid from one or more nozzles contained thereon. The reference to a "Z direction" in the claims is for convenience only and does not necessarily mean a direction perpendicular to the X and Y axes in a Cartesian coordinate system.

Figure 1:
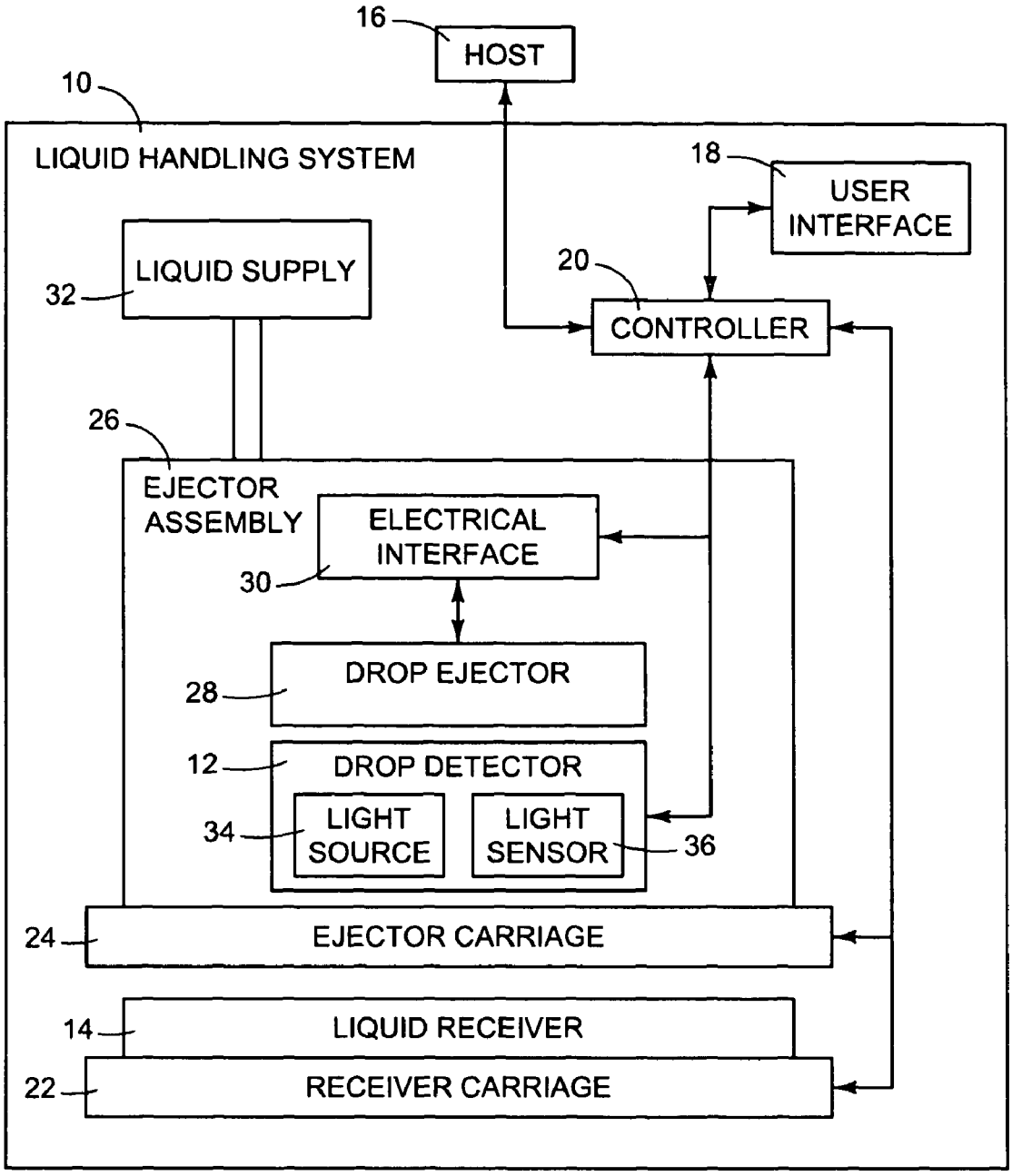
FIG. 1 is a block diagram illustrating an embodiment of an inkjet ALH system in which embodiments of the new drop detector may be implemented.

FIG. 1 is a block diagram illustrating one example of an inkjet ALH system 10 in which embodiments of a new drop detector 12 may be implemented. Referring to FIG. 1, system 10 is used to dispense a liquid (or plural liquids) into or on to a liquid receiver 14. In the embodiments described below with reference to FIGS. 2-7, for example, liquid receiver 14 is a well plate. Data and/or instructions may be communicated between liquid handling system 10 and a host 16 and through a local user interface 18. System 10 includes a controller 20, a receiver carriage 22 carrying liquid receiver 14 and an ejector carriage 24 carrying a drop ejector assembly 26. Ejector assembly 26 includes drop detector 12, a drop ejector 28 and electrical interface 30 associated with drop ejector 28 for communicating with controller 20. Controller 20 represents generally the processing, programming and memory for controlling the functions of the operational components of system 10, including receiver carriage 22, ejector carriage 24, ejectors 28 and drop detector 12. A liquid supply 32 operatively connected to drop ejector 28 supplies the desired liquid to ejector 28. Drop detector 12 includes a light source 34 for illuminating liquid drops ejected from ejector 28 and a miniature light sensor 36 for collecting and sensing light scattered off the illuminated drops.

Figure 2:
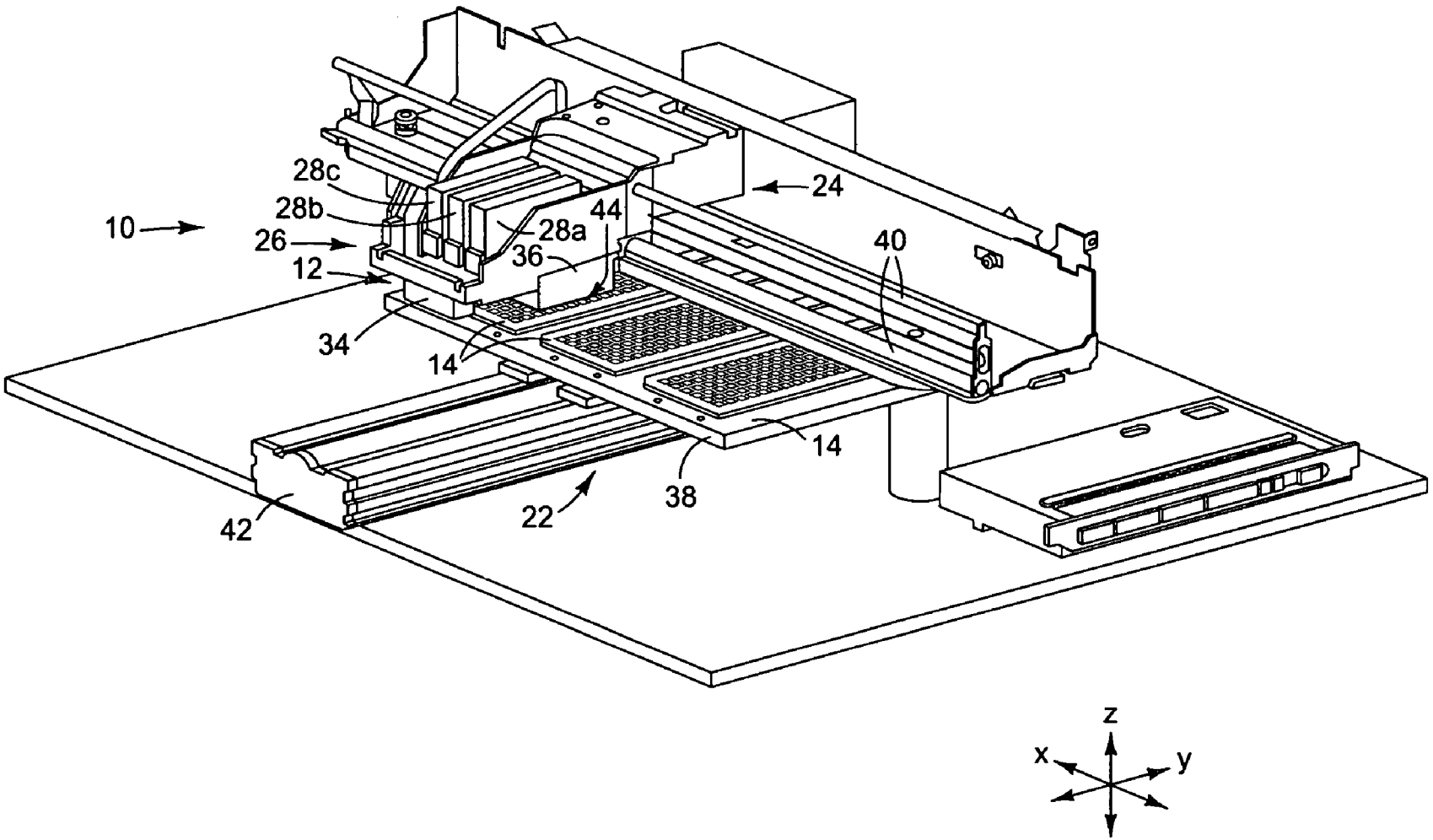
FIG. 2 is a perspective view illustrating components of an embodiment of an inkjet ALH system such as the one shown in the block diagram of FIG. 1.

FIG. 2 is a perspective view illustrating components of an embodiment of an inkjet ALH system 10 such as the one shown in the block diagram of FIG. 1. Referring to FIG. 2, system 10 includes three well plates 14 mounted on a table or other suitable base 38 carried by receiver carriage 22. Ejector assembly 26 carried by ejector carriage 24 includes three drop ejectors 28*a*, 28*b* and 28*c* for selectively dispensing liquids into individual wells in well plates 14 at the direction of controller 20 (FIG. 1). In the embodiment shown in FIG. 2, each drop ejector 28*a*-28*c* represents an ejector cartridge, sometimes referred to as a "pen" in the inkjet printing arts, that includes the operational components needed to dispense liquid received from one or more supplies 32 (FIG. 1). Such components are well known to those skilled in the art of inkjet drop dispensing and may include, for example, a liquid reservoir, a pressure regulator, and a thermal or piezoelectric printhead.

At the direction of controller 20 (FIG. 1), ejector carriage 24 moves along rails 40 in an X direction to position ejectors 28*a*-28*c* with respect to well plates 14 and receiver carriage 22 moves along a track 42 in a Y direction to position well plates 14 with respect to ejectors 28*a*-28*c*. In the embodiment shown in FIG. 2, a single drop detector 12 provides information to controller 20 regarding drops ejected from all three ejectors 28*a*-28*c*. A drop detector light source 34 is mounted to the front of ejector carriage 24. A light sensor 36 is mounted to one side of ejector carriage 24 near a drop zone 44 immediately adjacent to the ejector nozzles for each drop ejector 28 While it is expected that light source 34 will usually be implemented as a laser or other device for emitting a beam of light, any suitable light source may be used to illuminate drop zones 44. Also, configurations for light source 34 and light sensor 36 other than the one shown are possible. For example, a drop detector 12 for an ALH 10 may include a single light source 34 and one or more light sensors 36 for all drop ejectors 28 or multiple light sources 34 and multiple light sensors 36 for ejectors 28.

Figure 3:
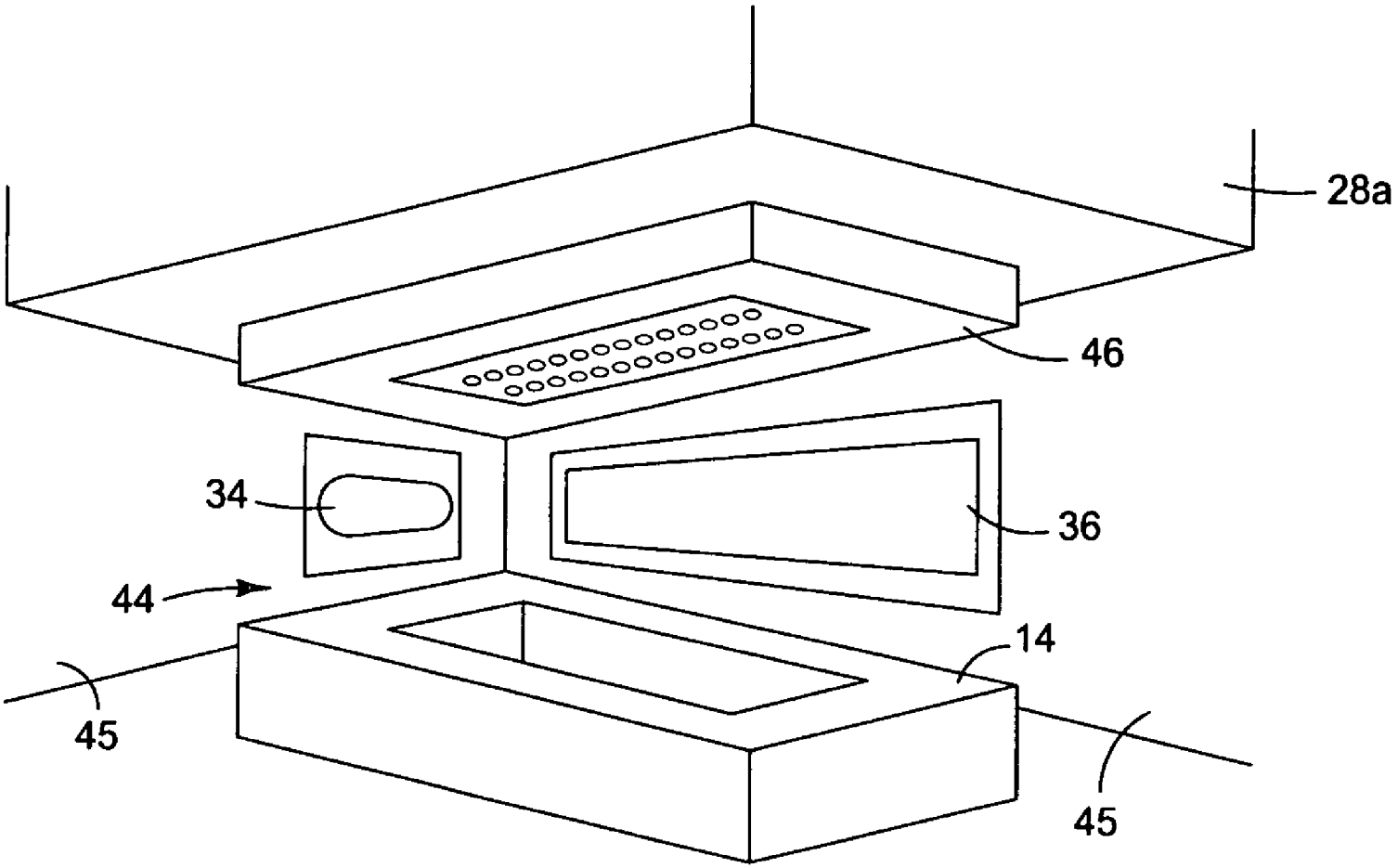
FIG. 3 is detail perspective view illustrating a stationary drop detector for a printhead drop zone in an ALH system.

In alternative configuration shown in FIG. 3, a stationary light source 34 and a stationary light sensor 36 may be used as an alternative to the movable source and sensor shown in FIG. 2. Referring to FIG. 3, a printhead 46 in ejector pen 28*a* ejects drops of liquid through drop zone 44 into a well in well plate 14 while pen 28*a* is positioned for drop detection near a stationary drop detector 12. Drop detector 12 includes a light source 34 and a light sensor 36 mounted any suitable stationary support structure 45.

Figure 4:
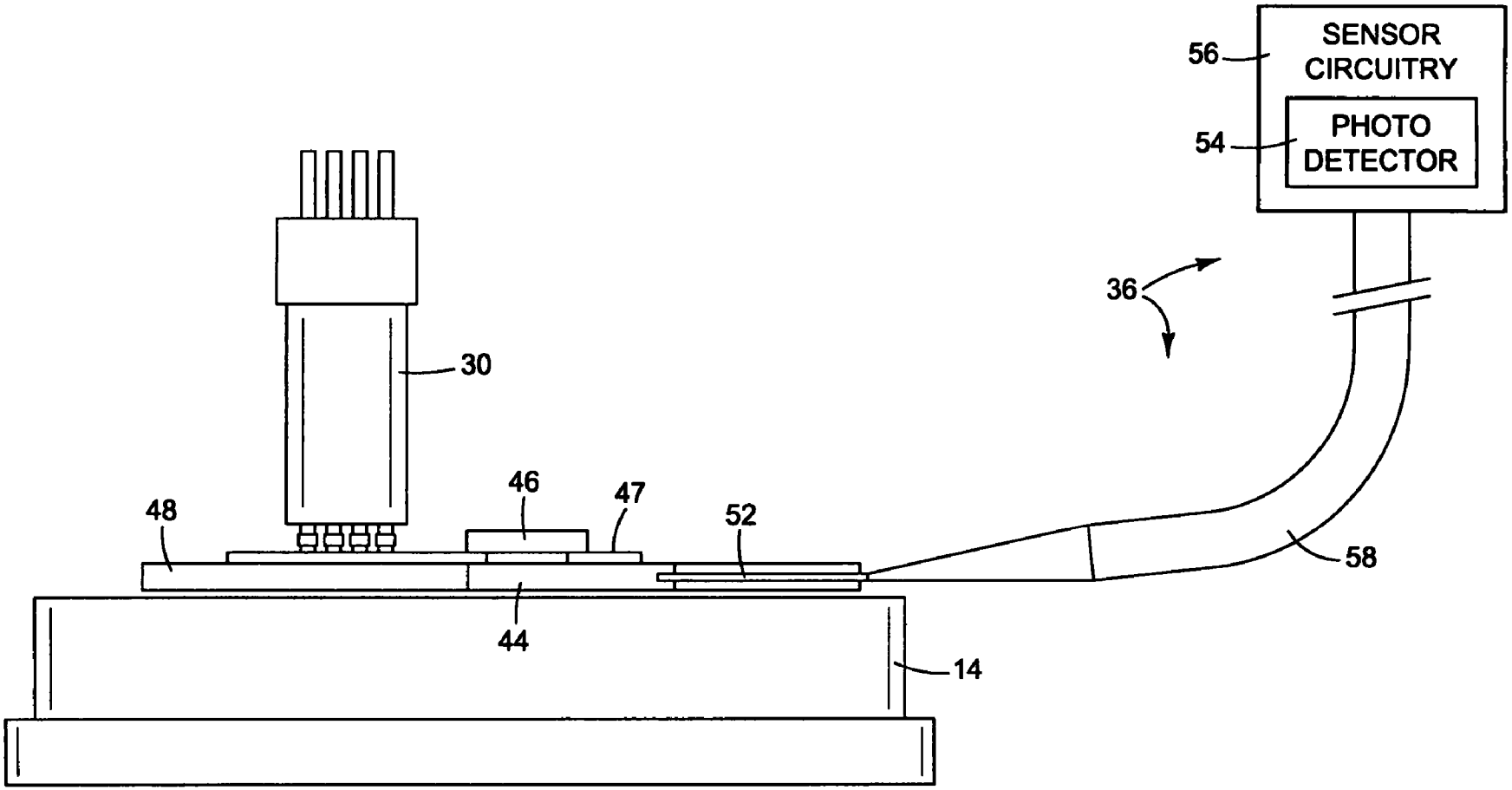
FIG. 4 is an elevation view illustrating a fiber optic light sensor for a drop detector according to an embodiment of the disclosure.
Figure 5:
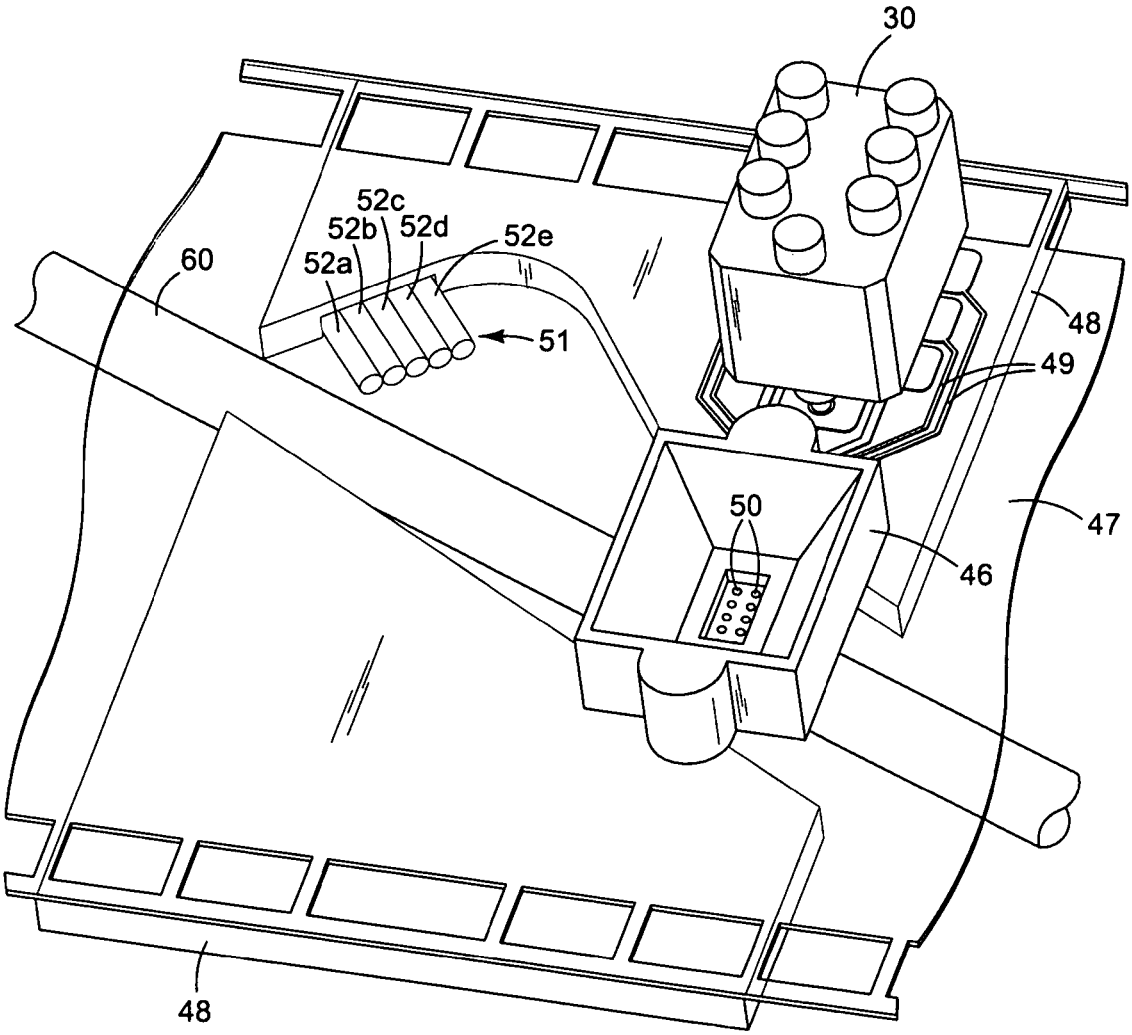
FIGS. 5 and 6 are top perspective and bottom plan views, respectively, illustrating an inkjet drop ejector and one example embodiment of a miniature light sensor for a drop detector.
Figure 6:
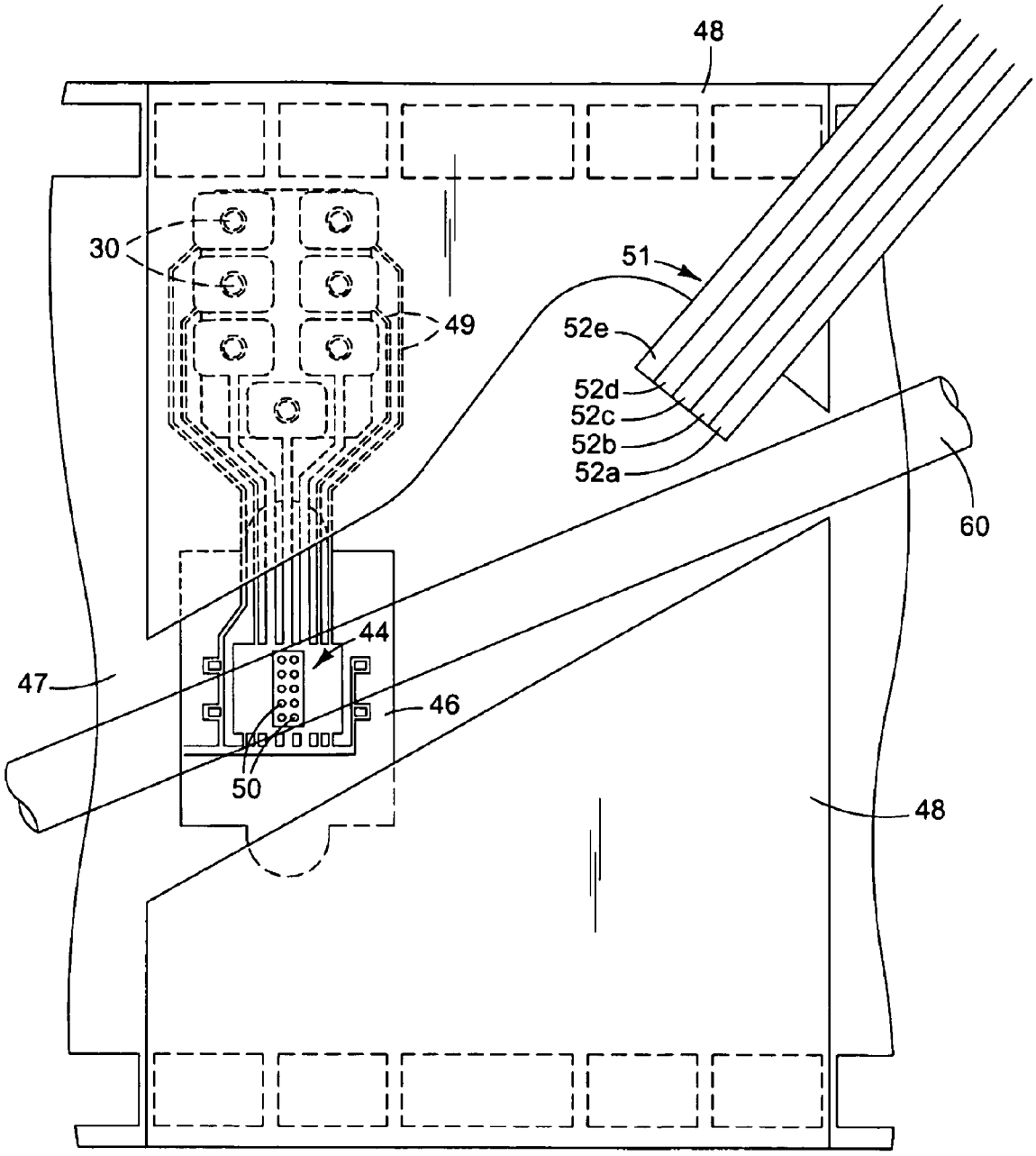

FIGS. 4-6 illustrate a drop ejector printhead 46 and a drop detector light sensor 36 constructed according to one embodiment of the disclosure. In the embodiment of FIGS. 4-6, printhead 46 is mounted to a flexible film or tape 47 such as might be used in a reel-to-reel type inkjet ALH system in which multiple printheads 46 are carried on a film 47 between two reels. Flexible film 47 is depicted as a transparent film for clarity in showing the underlying structures. Film 47, however, need not be transparent. FIG. 4 is an elevation view showing one example configuration for printhead 46, fiber optic drop light sensor 36, well plate 14, and drop zone 44. FIGS. 5 and 6 are top perspective and bottom plan views, respectively, illustrating one embodiment for the configuration of FIG. 4 in which the fiber optic light sensor 36 is integrated into a substrate 48.

Referring to FIGS. 4-6, printhead 46 is supported on or otherwise operatively connected to a flexible film 47 that carries signals traces 49 between printhead 46, and thus drop ejector 28, and electrical interface 30. Drops are ejected from an array of nozzles 50 on printhead 46 through a drop zone 44 into a well in well plate 14. For inkjet ALH applications, the length of drop zone 44 is 3 mm or less, usually only about 1.5 mm. That is to say, the distance between printhead nozzles 50 and well plate 14 in the Z direction (FIGS. 2 and 3) is 3 mm or less. It has been discovered that fiber optics may be used to enable the detection of light scattered off drops of liquid passing through such a short drop zone 44. Testing shows that individual optical fibers having a nominal diameter of 0.25 mm are able to detect light scattered off drops ejected from a printhead from a range of 5-15 mm. Fiber optic light sensor 36 may include an array 51 of individual optical fibers 52*a*, 52*b*, 52*c*, 52*d* and 52*e* exposed to drop zone 44. Using multiple fibers 52*a*-52*e* improves the sensitivity of sensor 36, allowing detection of a wider range of drop types (e.g., smaller and/or faster moving drops), and expands the viewing area to enable more uniform signal strength from opposite sides of a larger drop zone. Such fibers 52 less than 1 mm in diameter may be embedded in a stationary substrate 48 positioned near a drop detection area along the path of travel for printheads 46 on film 47.

A light beam 60 (FIGS. 5 and 6) illuminates drop zone 44. The small optical fibers 52*a*-52*e* transport light from beam 60 scattered off drops in drop zone 44 away from the tightly confined area near drop zone 44 to a photodiode or other suitable photo detector 54 located in a less confined area away from drop zone 44. Photo detector 54 and associated sensor circuitry 56, if any, in light sensor 36 convert light from fibers 52*a*-52*e* into electrical signals that may be passed on to controller 20 (FIG. 1). Suitable fiber optic light sensors 36 may include, for example, fiber optic light sensors commercially available from Keyence™ and Fiberoptic Systems™. As shown in FIG. 4, fibers 52 may be bundled together into a cable 58 away from drop zone 44 and routed to photo detector 54 and sensor circuitry 56.

Figure 7:
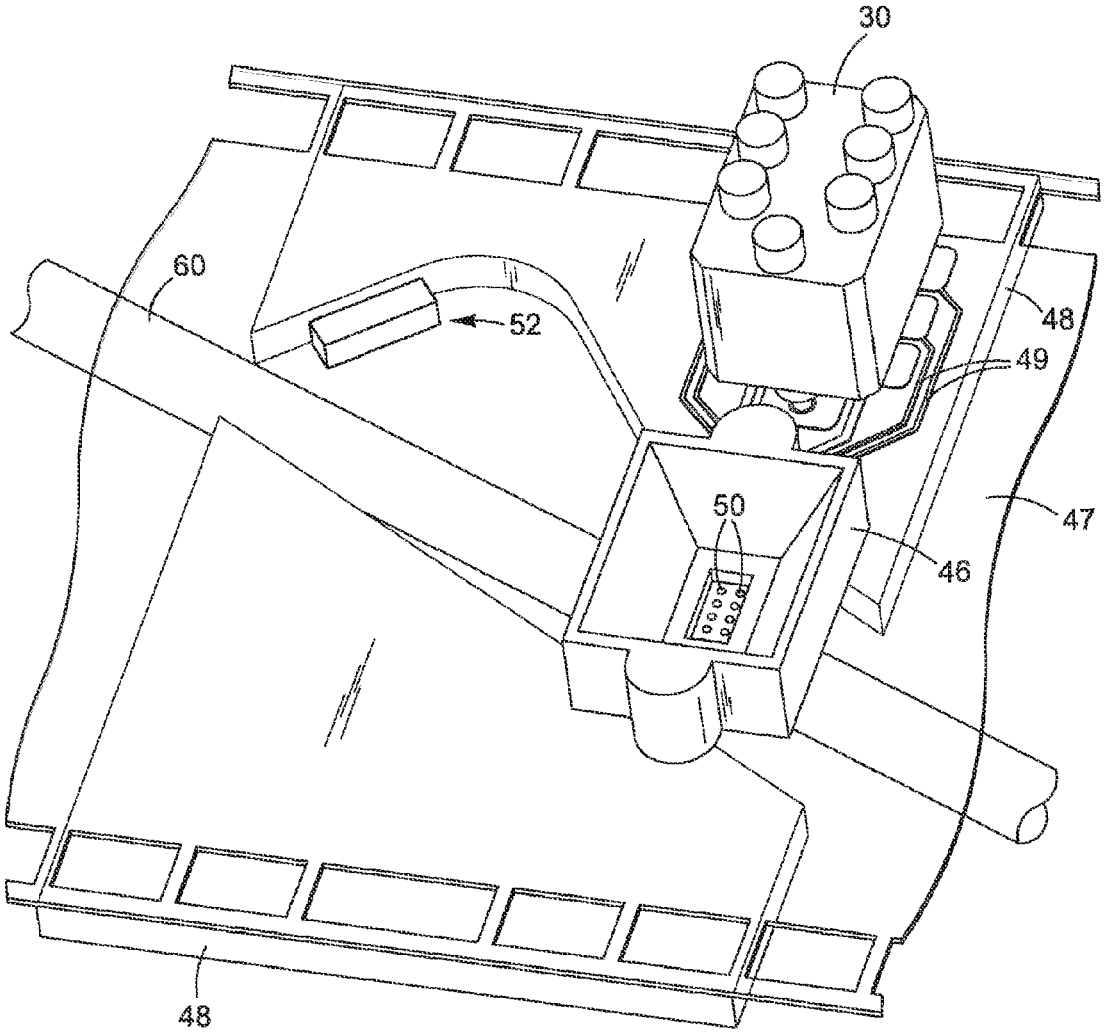
FIG. 7 is a top perspective view illustrating an inkjet drop ejector and another example embodiment of a miniature light sensor for a drop detector.
Figure 8:
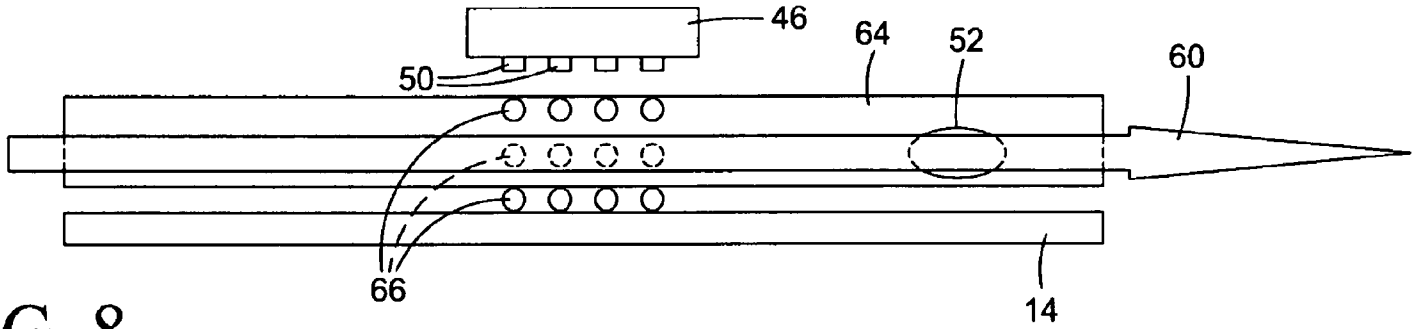
FIGS. 8-9, 10-11, 12-13, 14-15 and 16-17 are each elevation and plan views, respectively, illustrating various configurations for a drop detector, according to embodiments of the disclosure.
Figure 9:
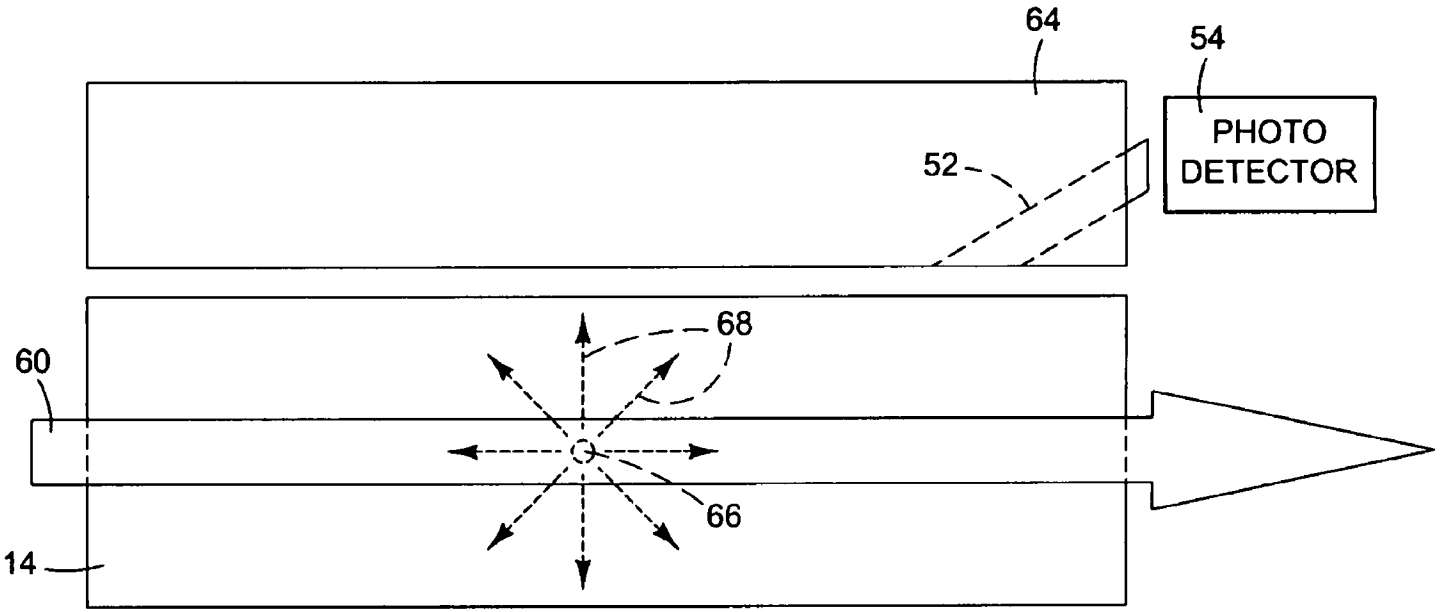

FIG. 7 illustrates another example embodiment for a miniature light sensor 52. Referring to FIG. 7, light sensor 52 supported in substrate 48 represents generally a miniature light sensor for collecting or sensing light scattered off the illuminated drops in drop zone 44. As noted above with reference to FIGS. 5 and 6, optical fibers may be used for sensor 52. It is expected that other technologies may also be used for sensor 52. For example, A small photodetector, such as a miniature CCD (charge coupled device) for example, may be used as sensor 52 to detect light scattered off the drops without needing fiber optics to transport light to a remote photo detector.

FIGS. 8-9, 10-11, 12-13, 14-15 and 16-17 illustrate various example configurations for a connection between an optical fiber 52 or an array 51 of multiple fibers 52 and one or more photo detectors 54. In the configuration shown in FIGS. 8 and 9, an individual optical fiber 52 is connected to a single photo detector 54. Optical fiber 52 is supported in a holder 64 (substrate 48 in FIGS. 4 and 5 for example) near drop zone 44. Drops 66 are ejected from nozzles 50 on printhead 46 through drop zone 44 into or on to liquid receiver 14. Light from beam 60 is scattered off drops 66, as indicated by arrows 68 in FIG. 9. Some of the light scattered off drops 66 is transported through optical fiber 52 to photo detector 54.

Figure 10:
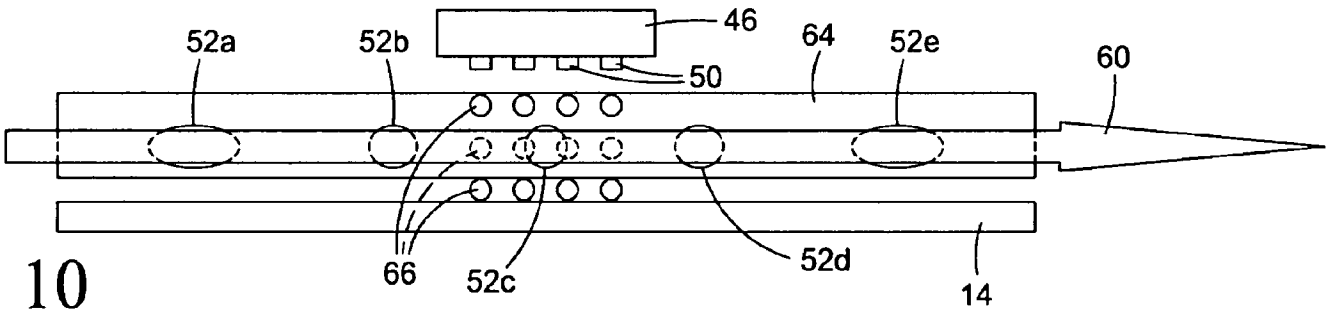
Figure 11:
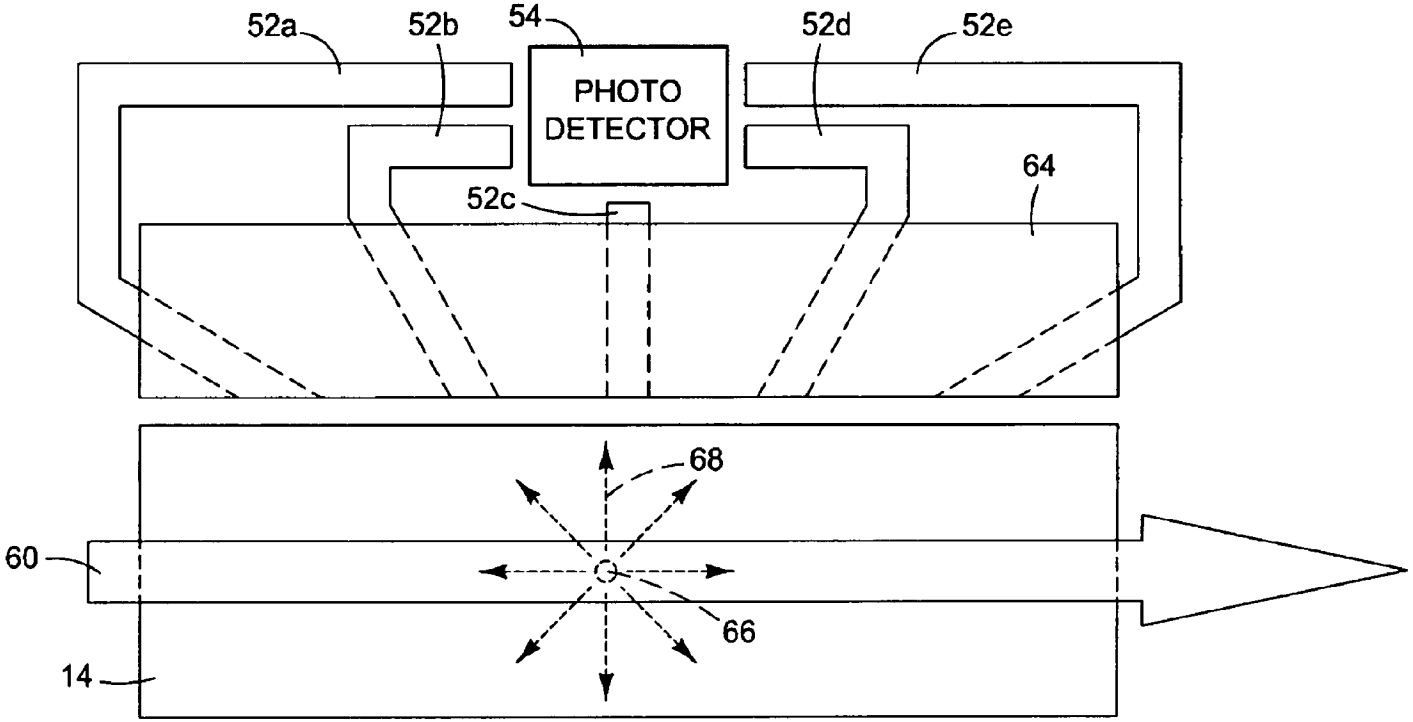
Figure 12:
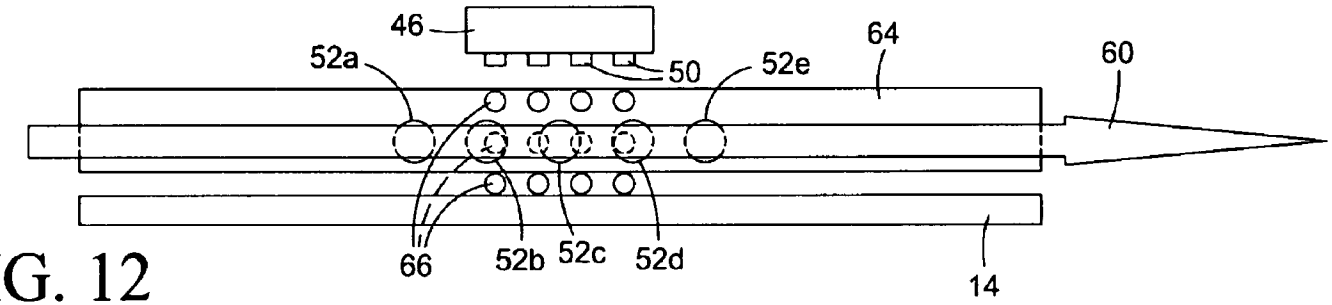
Figure 13:
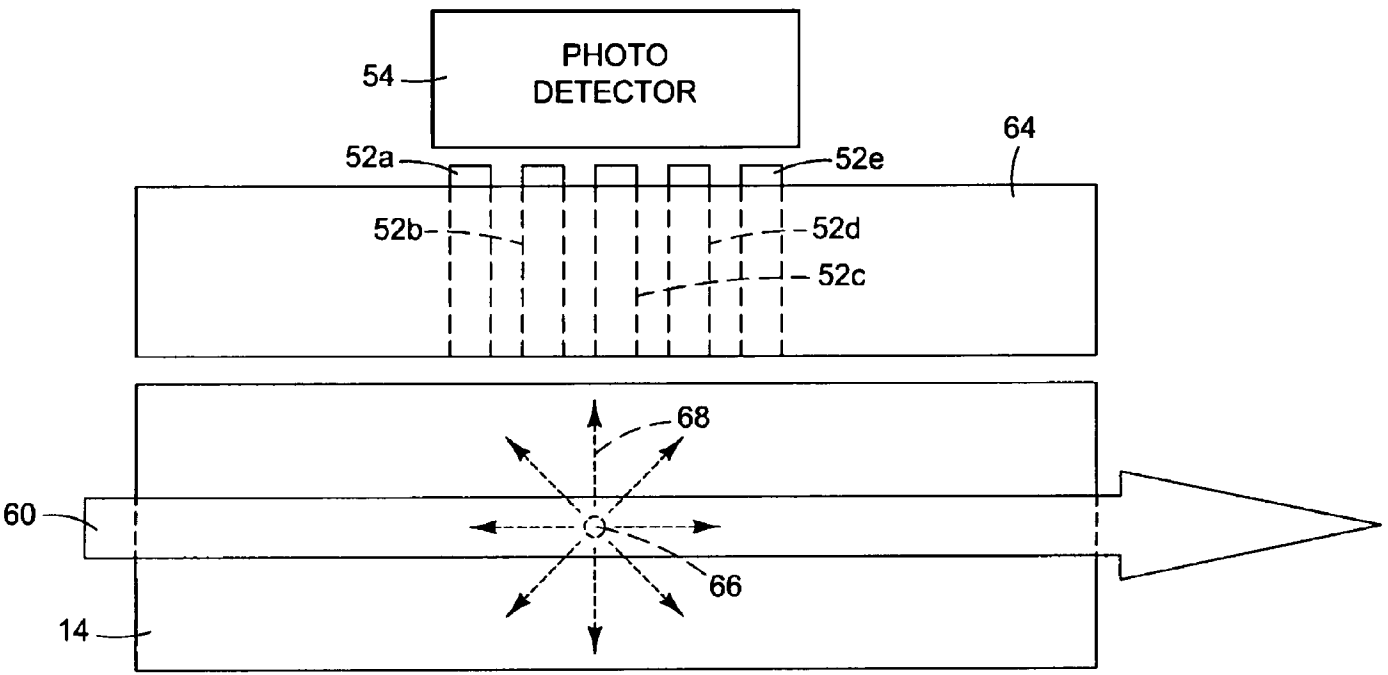
Figure 14:
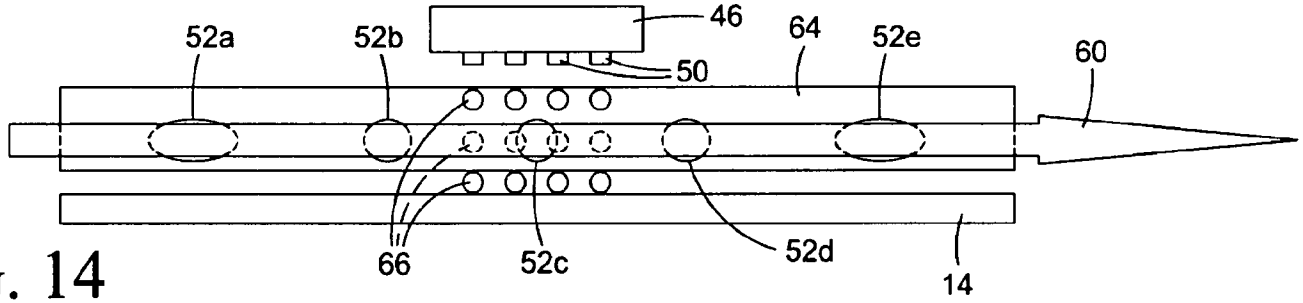
Figure 15:
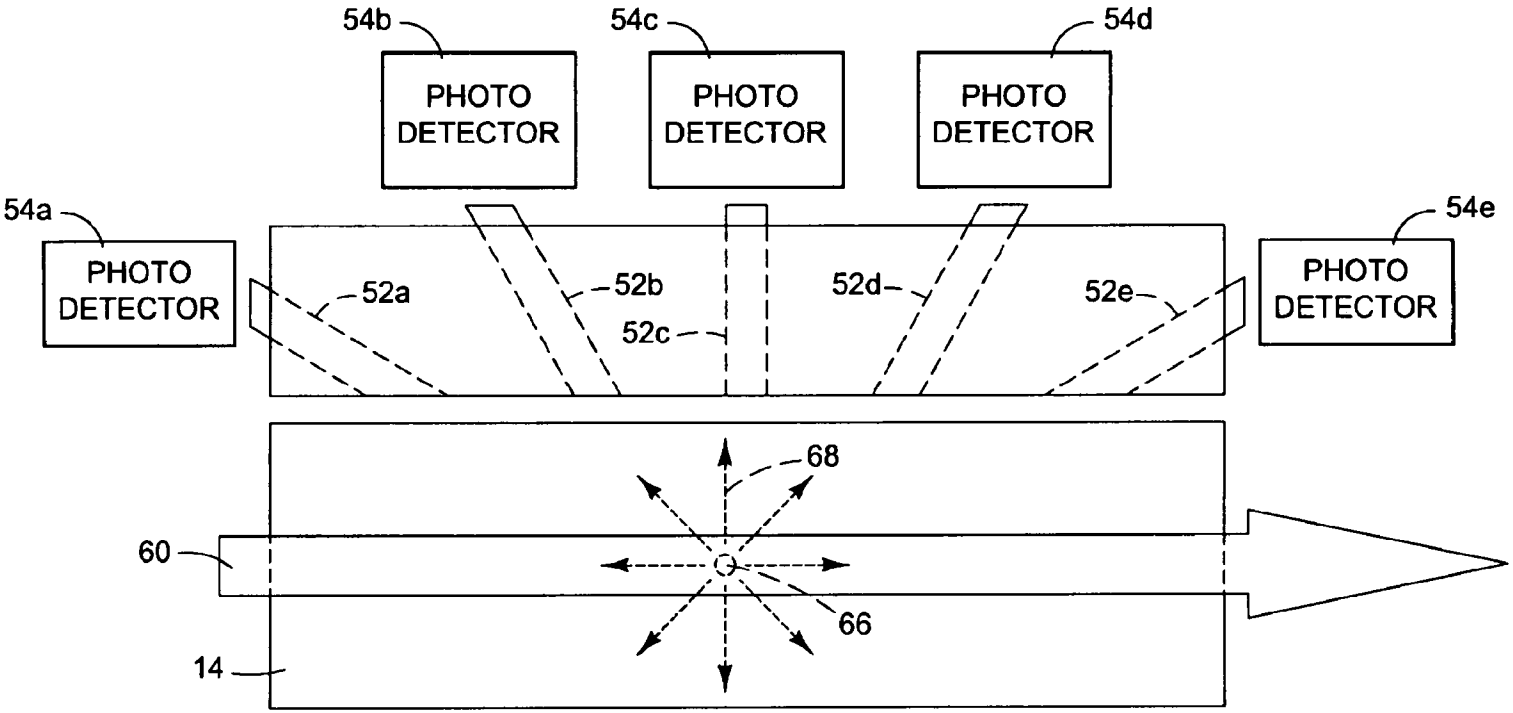
Figure 16:
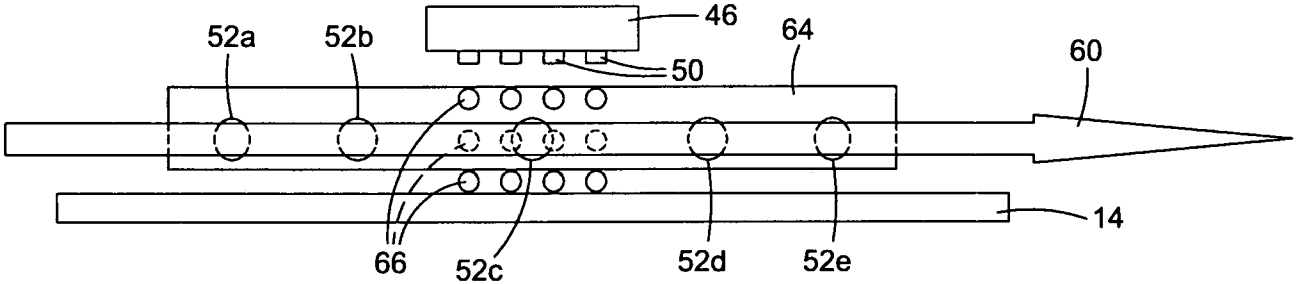
Figure 17:
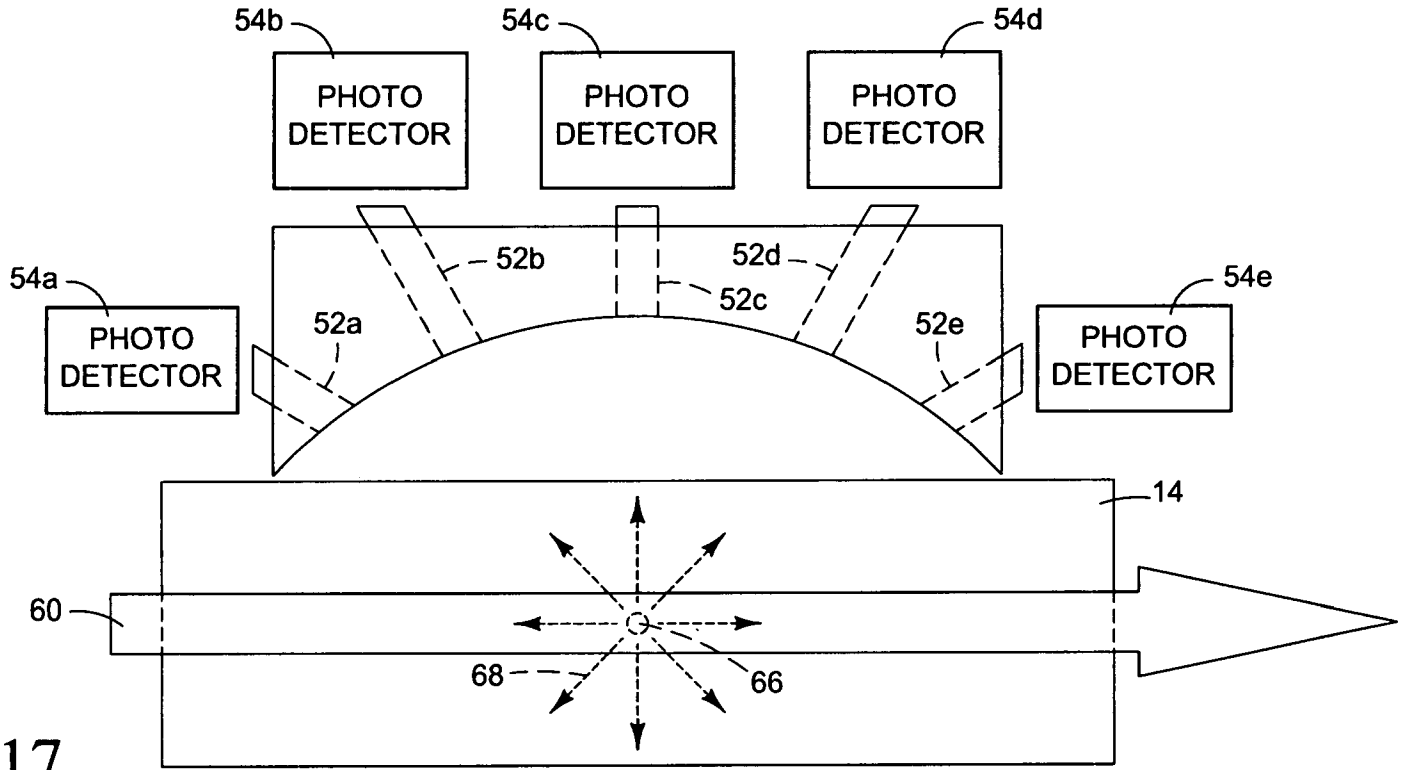

In the configuration shown in FIGS. 10 and 11, multiple optical fibers 52*a*-52*e* in an array 51 arranged in a straight line laterally across drop zone 44 are connected to a single photo detector 54. In the configuration shown in FIGS. 12 and 13, all of the optical fibers 52*a*-52*e* in a more compact array 51 arranged in a straight line laterally across drop zone 44 are connected to a single photo detector 54. The configurations shown in FIGS. 10, 11 and 12, 13 are suitable for larger drop zones to help equalize signal strength from drops ejected through different nozzles in the drop zone. In the configuration shown in FIGS. 14 and 15, each of multiple optical fibers 52*a*-52*e* in an array 51 arranged in a straight line laterally across drop zone 44 is connected to a corresponding one of multiple photo detectors 54*a*-54*e*. In the configuration shown in FIGS. 16 and 17, each of multiple optical fibers 52*a*-52*e* in an array 51 arranged in an arc laterally across drop zone 44 is connected to a corresponding one of multiple photo detectors 54*a*-54*e*. The configurations shown in FIGS. 14, 15 and 16, 17 enable more extensive drop characterization based on angular distribution of the scattered signal, with the configuration of FIGS. 16 and 17 more suitable for a larger drop zone.

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. A liquid handling system, comprising:

a liquid supply;

a drop ejector operatively connected to the liquid supply, the ejector having nozzles through which drops of liquid are ejected through a drop zone toward a drop receiver, the drop zone having a length less than or equal to 3 mm in a Z direction between the nozzles and the receiver;

a movable carriage carrying the drop ejector for positioning the drop ejector relative to a drop receiver;

a light source for illuminating drops of liquid passing through the drop zone;

a light sensor exposed to the drop zone for sensing light from the light source scattered off drops of liquid as the drops pass through the drop zone, the light sensor supported in a substrate at least partially surrounding the ejector nozzles and having a cross sectional dimension in the Z direction less than the length of the drop zone;

a photo detector operatively connected to the light sensor for converting light from the light sensor into an electrical signal; and a controller operatively connected to the drop ejector and the photo detector for selectively ejecting drops from the ejector, and to the ejector carriage for moving the ejector carriage to position the ejector relative to a drop receiver.

2. The system of claim 1, wherein the light sensor and the photo detector comprise a single device.

3. The system of claim 1, wherein the light sensor comprises a fiber optic light sensor.

4. The system of claim 3, wherein the optical fibers in the sensor are supported in a recess in the substrate and the optical fibers have a cross sectional dimension less than a thickness of the substrate.

5. The system of claim 1, further comprising:

a base for supporting a drop receiver;

a movable carriage carrying the base for positioning the drop receiver on the base relative to the drop ejector; and the controller operatively connected to the base carriage for moving the base carriage to position a drop receiver on the base relative to the drop ejector.

6. The system of claim 5, further comprising a drop receiver supported on the base.

* * * * *